US006000895A

United States Patent [19]

Maes

[11] Patent Number: 6,000,895

[45] Date of Patent: Dec. 14, 1999

[54] DEVICE FOR OPENING A BINDING ELEMENT

[75] Inventor: Dirk Maes, Lokeren, Belgium

[73] Assignee: Esselte N.V., Sint Niklaas, Belgium

[21] Appl. No.: 08/904,620

[22] Filed: Aug. 1, 1997

[30] Foreign Application Priority Data

Aug. 9, 1996 [EP] European Pat. Off. ..... 96112869

[51] Int. Cl.[6] ..... B42B 5/08

[52] U.S. Cl. ..... 412/15; 402/57; 412/38; 412/39; 412/40; 412/42

[58] Field of Search ..... 402/57; 412/38, 412/39, 40, 42

[56] References Cited

FOREIGN PATENT DOCUMENTS 0 395 873 11/1990 European Pat. Off. .
830636 2/1952 Germany ..... 412/40
23 62 440 6/1974 Germany .

*Primary Examiner*—Willmon Fridie, Jr.
*Assistant Examiner*—Mark T. Henderson
*Attorney, Agent, or Firm*—Jones, Tullar & Cooper, P.C.

[57] ABSTRACT

The present invention is directed to a device for opening a binding element for receiving perforated sheets, the binding element comprising a spine and a plurality of relatively spaced ring elements arranged side by side, with the free ends of the ring elements resiliently engaging the binder spine when closed. A low-cost device for opening a binding element is provided. The device includes a front section, a rear section having at least the same length as the binding element and being dimensioned such that, when the device is inserted into the binding element, the ring elements successively come into contact with the outer areas of the rear section, and that the free ends of the ring elements are spaced at least up to a specified distance from the spine, and a curved surface area provided at least in the rear section and being partly engaged by the inner surfaces of the ring elements.

17 Claims, 6 Drawing Sheets

Fig. 4b
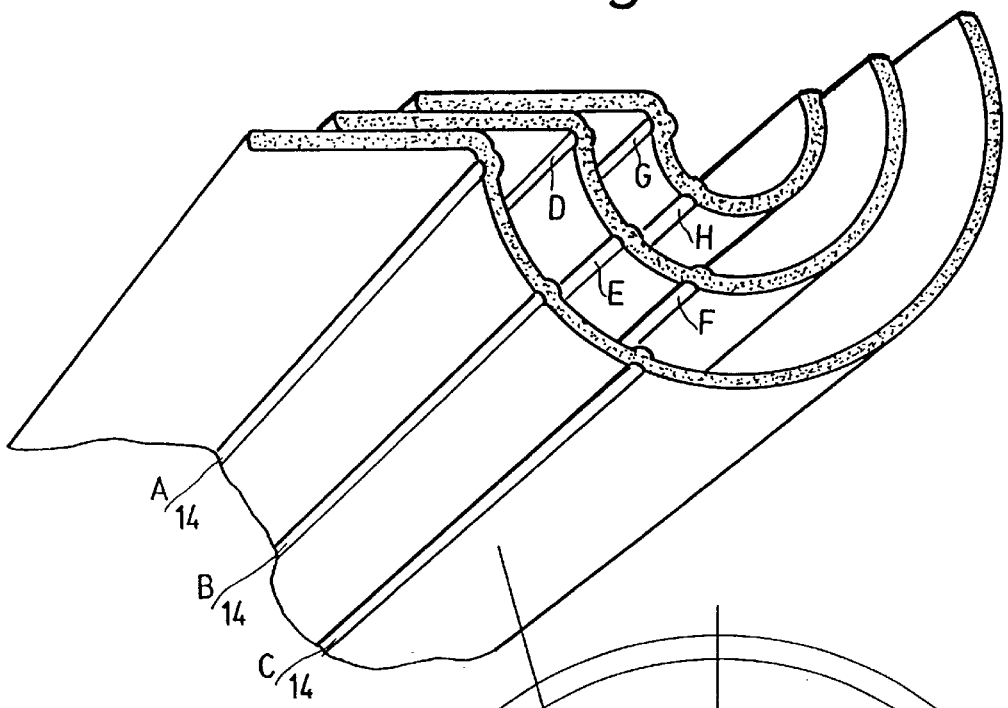
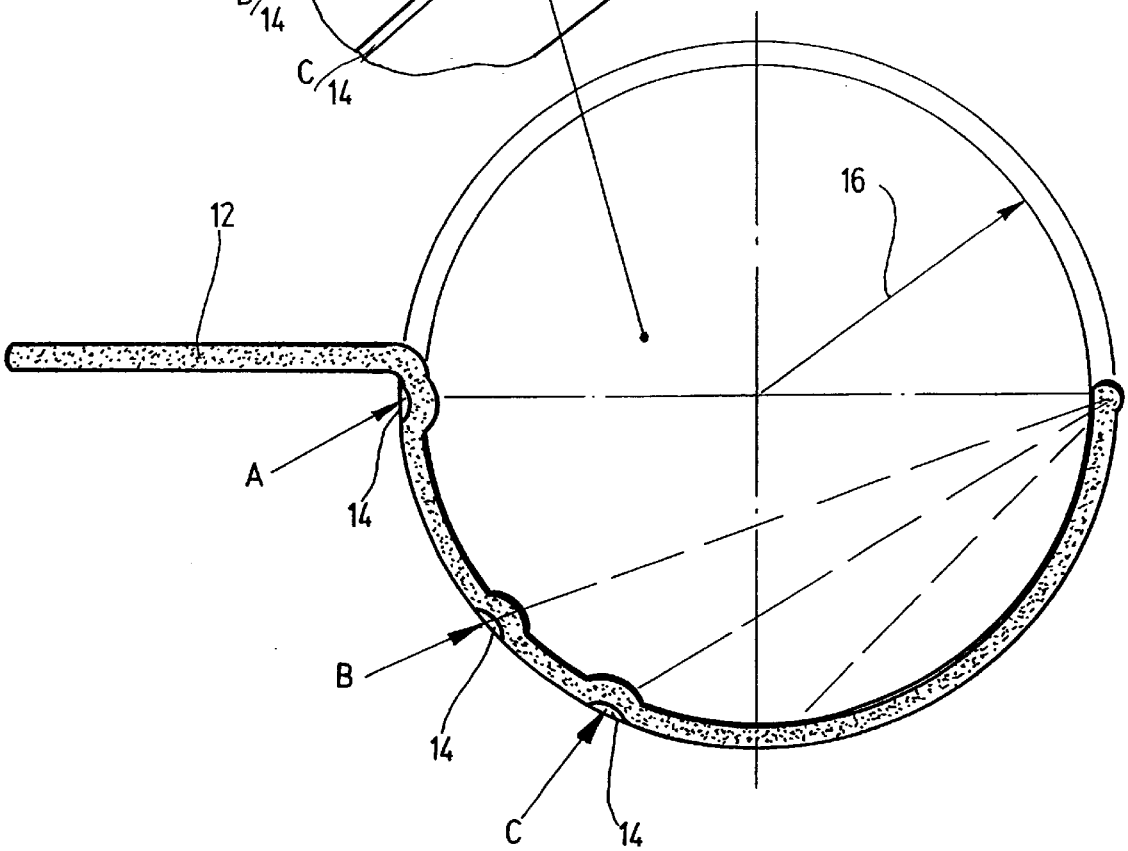
Fig. 4a

DEVICE FOR OPENING A BINDING ELEMENT

FIELD OF THE INVENTION

The present invention relates to a device for opening a binding element for receiving perforated sheets, the binding element comprising a spine and a plurality of relatively spaced ring elements arranged side by side, with the free ends of the ring elements resiliently engaging with the binder spine when closed.

BACKGROUND OF THE INVENTION

From German published application DE-OS 23 62 440 a device for opening a binding element is already known. This device is comprised of a flat element of a length greater than the length of the binding element and of a width greater than the diameter of the ring elements when closed. To facilitate the introduction of the device into the binding element, the device is tapered in the direction of insertion. By reason of the above-described dimensioning of the device, the ring elements of the binding element are bent open following insertion of the device in the binding element, their cross-section then having the form of an upwardly open ellipse. Then the perforations of a stack of sheets are placed onto the free ends of the ring elements. The ring elements being of a resilient configuration, they return to their initial position as soon as the device is withdrawn from the binding element. The individual sheets of the stack are held together by means of the binding element.

A further embodiment of a tool for opening a binding element is disclosed in European Patent EP 0 395 873 B1. This tool is equally of a flat configuration and has a leading section of a length at least the length of the binding element to be opened, with the width of the leading section being smaller than the diameter of the closed ring elements of the binding element. Adjoining the leading section in opposition to the direction of insertion is a succeeding section of a length again at least equaling the length of the binding element to be opened, yet of a width greater than the diameter of the ring elements when closed. Provided between these two sections is a further section which in the direction of insertion is as wide as the leading section while widening progressively in opposition to the direction of insertion until its width equals the width of the succeeding section. To open or close the binding element, the tool is pulled axially through the ring elements of the binding element.

Both known elements have the disadvantage that a flat tool automatically comes to lie in the plane of the large main axis of the ellipse when in the interior of the opened elliptical binding element. As a consequence, the length of the free ends of the ring elements is limited to the portion lying above the main axis. Therefore, with the format of the binding element given, the tool is only suited to bind relatively thin stacks of perforated sheets.

In addition, the tool described in European Patent EP 0 395 873 is very awkward to handle because of its dimensions, its length being at least double the length of the binding element employed.

SUMMARY OF THE INVENTION

It is therefore an object of the present invention to provide a low-cost device for opening a binding element which in addition ensures optimum opening of a binding element.

This object is accomplished by a front section and a rear section having at least the same length as the binding element and being dimensioned such that, when the device is inserted into the binding element, the ring elements successively come into contact with the outer areas of the rear section, and that the free ends of the ring elements are spaced at least up to a specified distance from the spine; still further, a curved surface area against which the inner surfaces of the ring elements partly engage is provided at least in the rear section.

According to a preferred embodiment of the device of the present invention, provision is made for both the front section and the rear section to be formed as a flat element; the edge of the flat element on the side close to the spine extends in an essentially straight line, while the side of the front section close to the free ends of the binding element is tapered in the direction of insertion; moreover, the curved surface area is positioned above the straight edge of the rear section and possibly of the front section.

As set forth in the foregoing in connection with the prior art, the main disadvantage of a flat insertion element is that its range of application is limited to relatively thin stacks of sheets when the format of the binding element is predetermined. The range of application can be extended significantly by means of the device of the present invention, in particular by the curved area arranged above the straight edge of the flat element. The flat portion of the device of the present invention is automatically positioned in a plane located parallel to and beneath the plane of the large main axis of the ellipse. This enables substantially thicker stacks to be bound using small-format binding elements.

With reference to the preceding statements, it will be readily understood when it is proposed in an advantageous further aspect of the device of the present invention that the curved surface area have the curvature of an ellipse in the area of the large main axis. As a result, the corresponding inner surfaces of the ring elements engage the curved surface area fully. This again ensures that the device of the present invention aligns itself in the desired position by its own accord as it is inserted into the binding element.

For the purpose of optimizing the device, provision is made further for an abutment strip that is affixed to the free edge of the curved surface area and extends essentially parallel to the flat element.

It has proven to be particularly advantageous to have a second curved surface area adjoin the opposite free edge of the flat element. The result thereby achieved is the following: When a force is exerted from below on the opened binding element upon insertion of the device, the corresponding inner surfaces of the ring elements snugly engage the second curved surface area, thereby increasing the free ends of the ring elements and hence enabling the binding of still thicker stacks of sheets using small-format binding elements.

According to an advantageous further aspect of the device of the present invention, it is proposed that the free edge of the flat element or of the second curved surface area on the side close to the free ends of the ring elements include indentations for alignment of the ring elements. This facilitates loading of the stack of perforated sheets into the ring elements of the binding element significantly.

To extend the area of application of the device of the present invention to accommodate all conventional binding element formats, an advantageous further aspect makes provision for several first curved surface areas which are arranged at different distances from the straight edge of the flat element.

In an alternative embodiment of the device of the present invention, the curved surface area is of a cylindrical configuration and has an opening angle of at least 180 degrees.

To be able to utilize the device for a wide variety of binding element formats, parallel grooves are provided on the outside of the cylindrical surface area, such grooves extending essentially vertically to the radius of the cylindrical surface area. These grooves receive the free edge of the spine in dependence upon the individual format of the binding element. In particular, the relative distance of the grooves is dimensioned so as to enable the device to be put to optimum use for the conventional binding element formats.

In an alternative configuration of the device of the present invention, the following is proposed: Both the front section and the rear section have essentially the same curvature—the flat element being accordingly omitted in this configuration. The device is inserted into the binding element such that the free ends of the binding element are lifted clear of the spine only a small amount. Actual opening of the binding element is then accomplished by turning the device in the interior of the binding element.

In this connection, it has proven to be eminently suitable to arrange rib members on the inside of the curved surface area, such rib members extending parallel to each other and being aligned essentially vertically to the radius of curvature. These rib members serve the function of supporting the free edge of the spine of the binding element in dependence upon the binding element's format as the device is being turned.

The device of the present invention combines advantageously with an apparatus for perforating stacks of sheets. Particularly suitably, the device of the present invention is arranged on the apparatus for perforating stacks of sheets by means of resiliently mounted elements. This enables the device of the present invention plus binding element to be pressed in a simple manner against a firm support—for example, the surface of the perforating apparatus—which, as set forth in the foregoing, results in an increase in the length of the free ends of the binding element's ring elements.

BRIEF DESCRIPTION OF THE DRAWINGS

The present invention will be described in more detail in the following with reference to the accompanying drawings. In the drawings.

FIG. 4*a* is a cross-sectional view of a second embodiment of the device of the present invention;

FIG. 4*b* is a perspective view of devices of FIG. 4*a* of the present invention;

DESCRIPTION OF THE PREFERRED EMBODIMENTS

Figure 1:
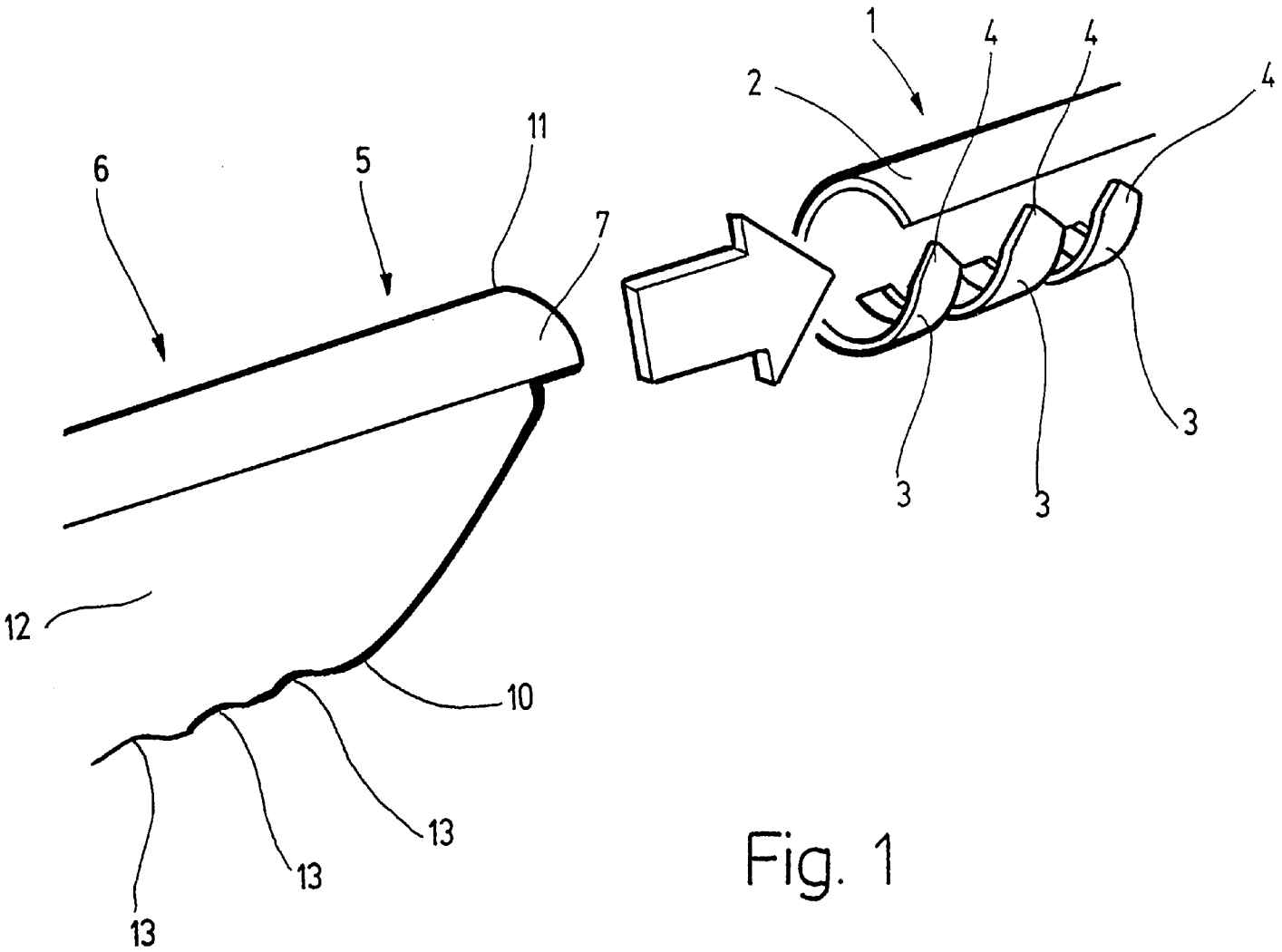
FIG. 1 is a perspective view of a first embodiment of the device of the present invention.

Referring to FIG. 1, the device for opening a binding element 1 comprises a flat element 12 having a front section 5 and a rear section 6, with the front section 5 tapering in the direction of insertion of the device into the binding element 1. In FIG. 1, the direction of insertion is identified by an arrow.

Provided in the area of the straight edge of the flat element 12 is a curved surface area 7 whose free edge is bounded by an abutment strip 11 (optionally). The free edge 10 of the flat element 12 includes indentations 13 spaced from each other by a distance substantially equal to the relative distance of the spaced ring elements 3 of the binding element 1.

Figure 2:
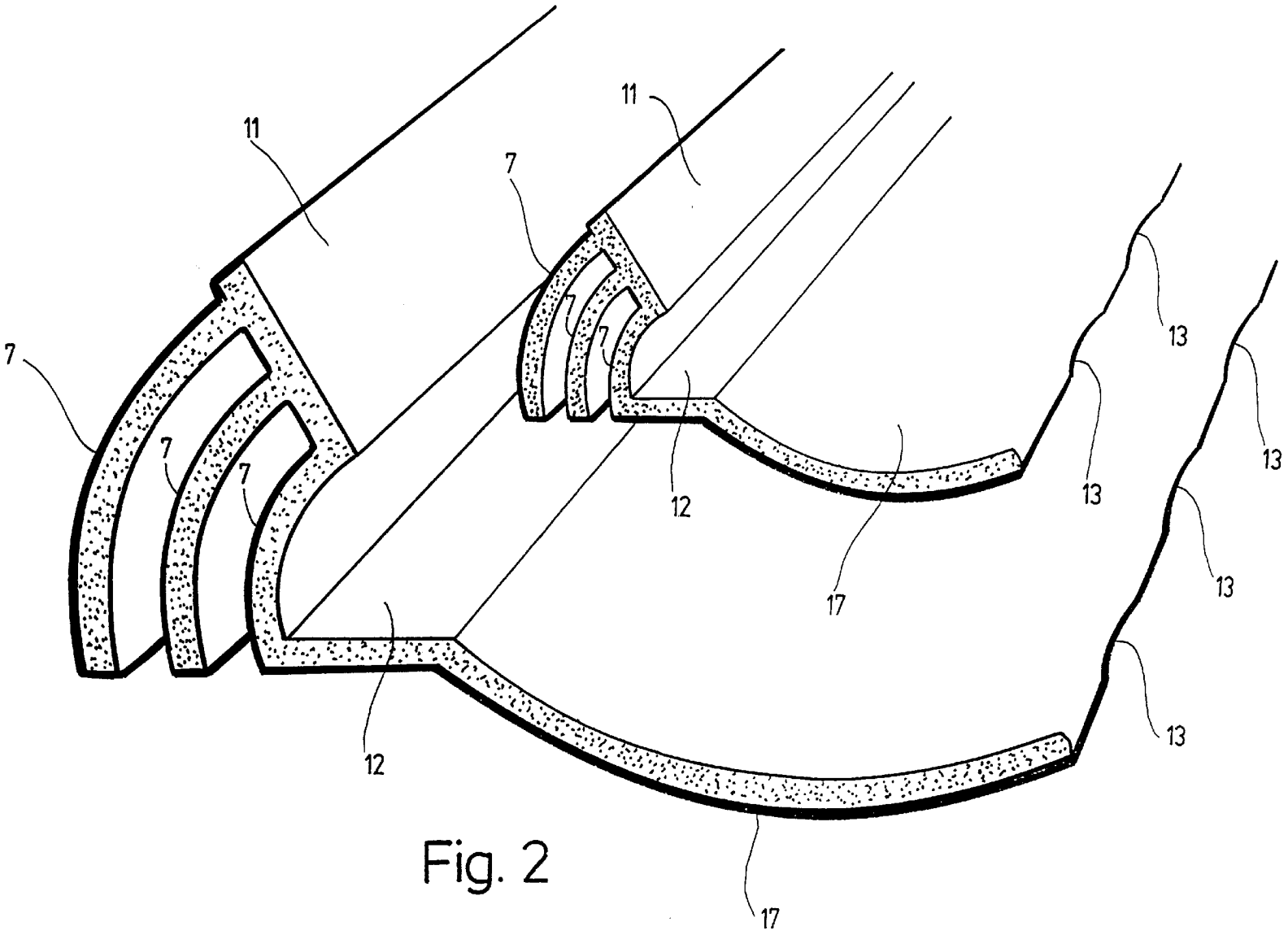
FIG. 2 is a perspective view of an advantageous feature of the first embodiment of the device of the present invention.

FIG. 2 is a perspective view of an advantageous feature of the first embodiment of the device of the present invention, which is suited for use with a plurality of different formats of binding elements 1. Adjoining an edge of the flat element 12 are curved surface areas 7 arranged in successive sequence. The curved surface areas 7 are connected with each other by means of the abutment strip 11.

Adjoining the edge lying opposite the first edge of the flat element 12 is a second curved surface area 17. While the curved surface areas 7 arranged in successive sequence serve the function of receiving different formats of binding elements 1, the second curved surface area 17 provides a support for the ring elements 3 when they are bent wide open by a force F acting from below.

Figure 3:
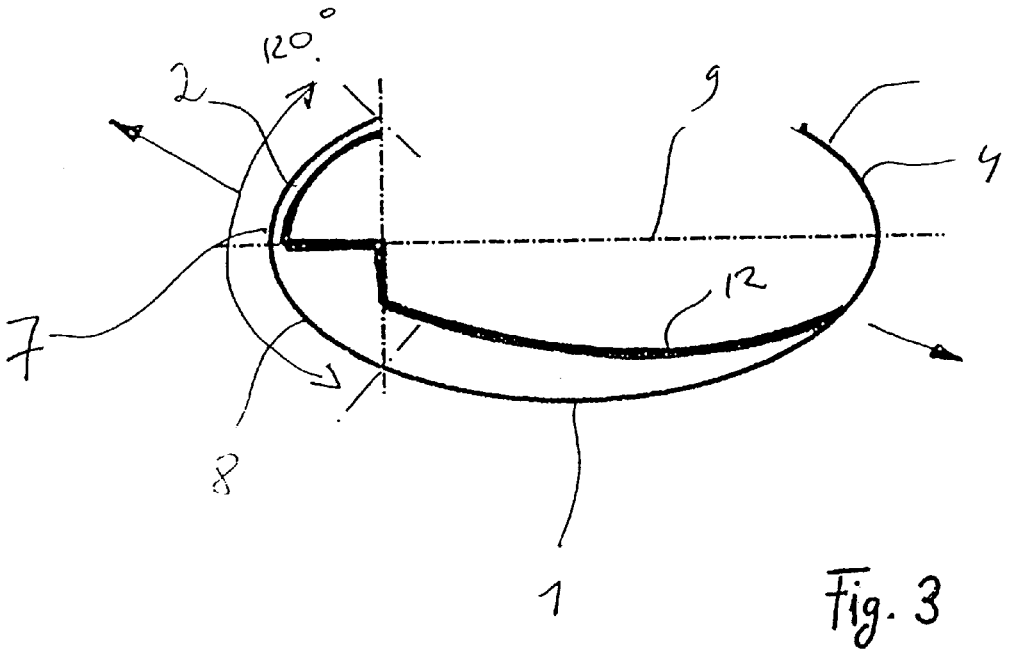
FIG. 3 is a schematic cross-sectional view of a binding element in open position showing the device of the present invention inserted.

The mode of operation of the present invention appears more clearly from FIG. 3 illustrating schematically in cross-section a binding element 1 in open position with the device of the present invention inserted. When only a flat element—as described in the prior art—is inserted into the binding element 1, it is aligned along the large main axis 9 of the ellipse 8 corresponding to the cross-sectional shape of the open binding element 1. The free ends 4 of the ring elements 3 subsequently holding the stack of perforated leaves are relatively short, which limits the number of leaves to be bound to a small thickness or, alteratively, requires the use of large-format binding elements 1.

The device of the present invention avoids this disadvantage in that the curved surface area 7 operates to urge the flat element 12—which may be slightly curved—into a plane lying beneath and essentially parallel to the plane in which the large main axis 9 of the ellipse 8 is situated. As becomes apparent from FIG. 3, this increases the length of the free ends 4 of the ring elements 3 of the binding element 1 materially.

In the embodiment of FIGS. 4*a* and 4*b*, a preferably cylindrical surface area with an opening angle of 180°, approximately, adjoins an edge of the flat section 12. Provided on the outside of the cylindrical surface area are grooves 14 serving for locking engagement of the free edge of the spine 2 of the binding element 1. The selection of the size of the device of the present invention as well as the selection of a particular groove 14 of a selected device is governed by the respective format of the binding element 1.

FIGS. 5 are perspective views of a final embodiment of the device of the present invention in different stages of application. FIG. 5*a* shows the device prior to its insertion into the binding element 1. The device is comprised of a tubular body with a split surface. In this embodiment, the front and the rear section are identical. It will be understood, of course, that it is possible for the front section to be optimized again to enable it to be inserted into the binding element 1 as readily as possible.

Figure 5A:
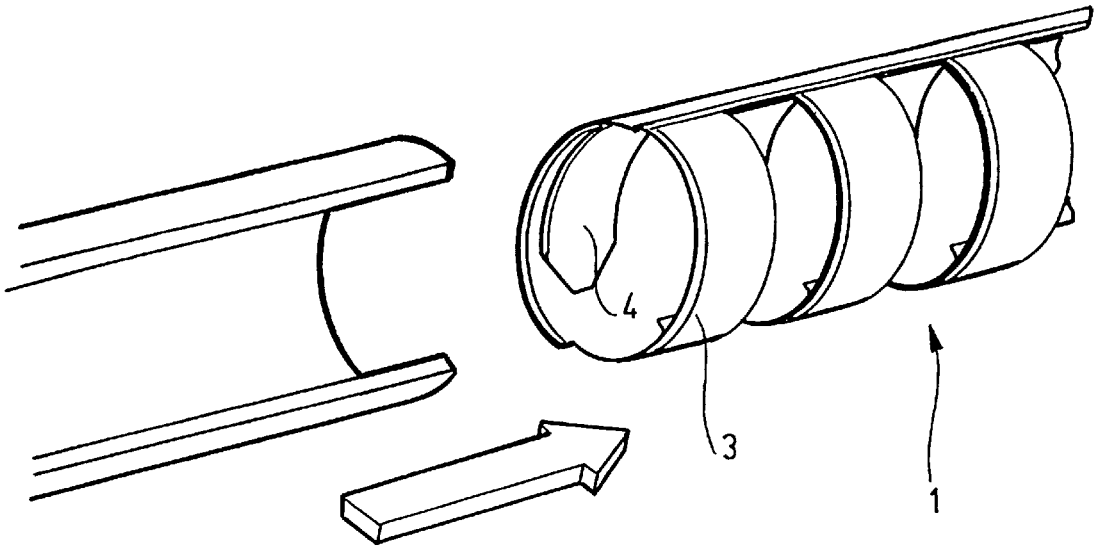
FIG. 5*a* is a perspective view of a third embodiment of the device of the present invention prior to its insertion into the binding element.
Figure 5B:
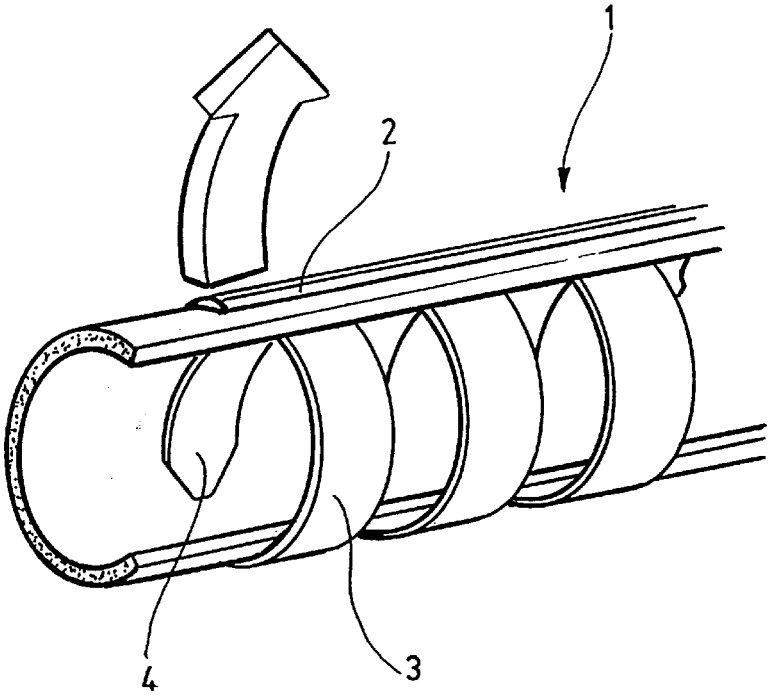
FIG. 5*b* is a perspective view of the embodiment of the device of the present invention of FIG. 5*a* following its insertion into the binding element.

Also in this embodiment, the arrow indicates the direction in which the device of the present invention is inserted into the binding element 1. During insertion, the individual free ends 4 of the ring elements 3 are lifted clear of the spine 2 a small amount, while engaging it resiliently when closed. FIG. 5*b* shows a perspective view of the device illustrated in FIG. 5*a* immediately upon its complete insertion into the binding element 1.

Figure 5C:
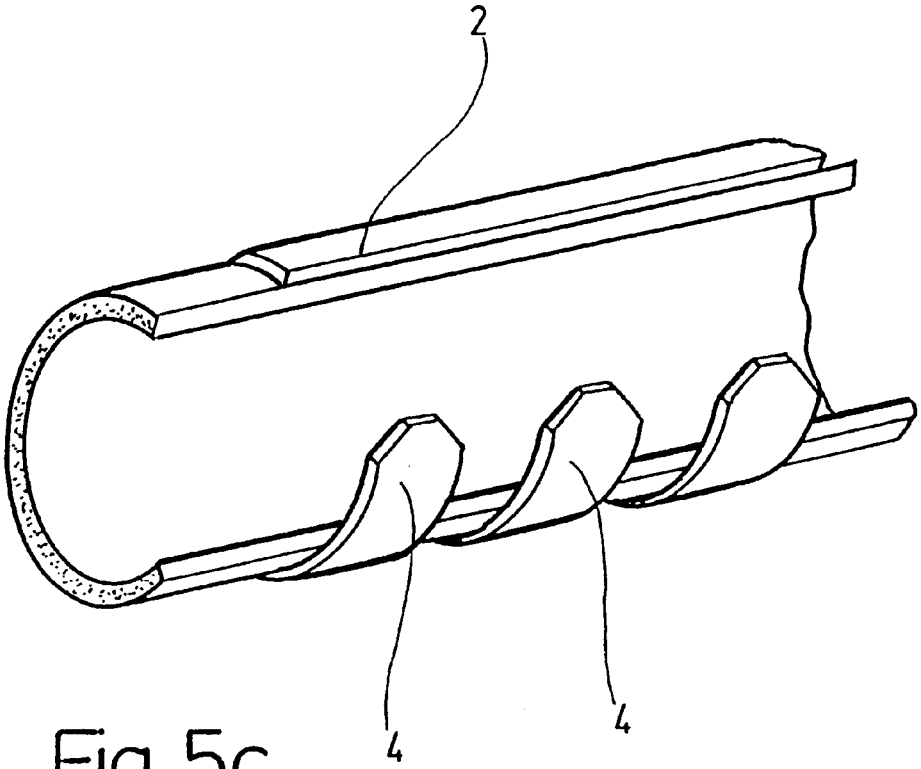
FIG. 5*c* is a perspective view of the embodiment of the device of FIG. 5*a* of the present invention after the binding element is fully opened.
Figure 5D:
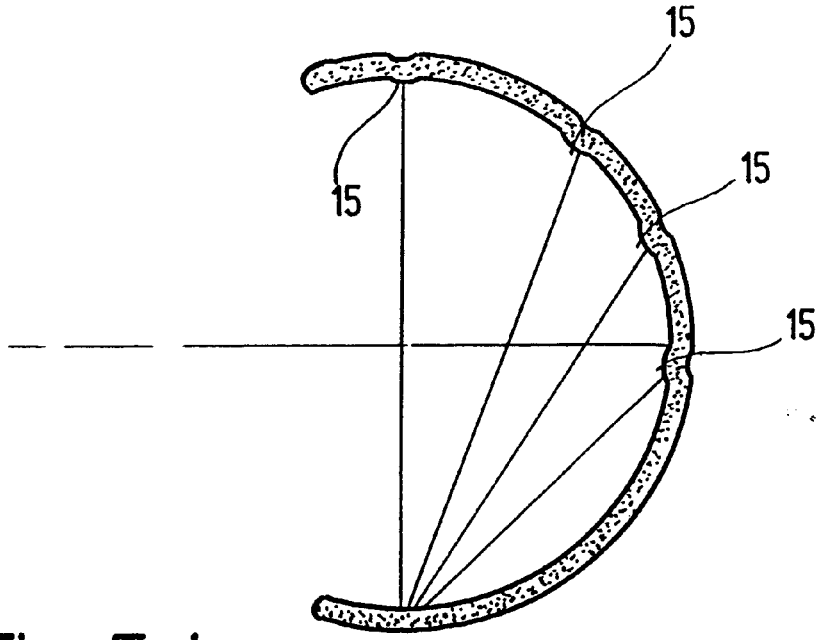
FIG. 5*d* is a cross-sectional view of the embodiment of the device of FIG. 5*a*, FIG. 5*b* and FIG. 5*c* of the present invention.

As becomes apparent from FIG. 5*b* and FIG. 5*c*, the actual opening operation of the binding element 1 is performed by turning the tubular device in the interior of the binding element 1. It is an advantage in this arrangement when the free edge of the spine 2 of the binding element 1 can take support upon an abutment strip 11 provided on the outer edge of the device (the abutment strip 11 being not shown separately in the FIGS. 5).

To be able to use this embodiment of the device of the present invention for different formats of binding elements 1 alike, parallel rib members 15 are arranged on the inside of the device. As set forth in connection with the embodiment previously described, these rib members serve for locking engagement of the free edges of the spines 2 of binding elements 1 of different formats.

I claim:

1. A device for opening a binding element which receives perforated sheets, the binding element having a spine and a plurality of spaced ring elements, arranged side-by-side along the spine, each ring element having a free end resiliently engaged with the spine when the binding element is closed, the binding element further having a given length, said device comprising:

a front section; and a rear section having at least the same length as the given length of the binding element, said rear section having a curved surface area and an outer area, wherein said rear section and said front section define a straight edge, both said front section and said rear section are formed as a flat element having an edge, said edge on a side thereof close to the spine extends in a straight line, with a side of said front section close to the free ends of the binding element being tapered in the direction of insertion of the device, and with said curved surface area being positioned above said straight edge of one of said rear section and said front section, wherein said rear section is dimensioned such that, when the device is inserted into the binding element, the ring elements come into contact, successively with said outer area of said rear section, and wherein the free ends of the ring elements are spaced at least up to a specified distance from the spine.

2. A device for opening a binding element which receives perforated sheets, the binding element having a spine and a plurality of spaced ring elements, arranged side-by-side along the spine, each ring element having a free end resiliently engaged with the spine when the binding element is closed, the binding element further having a given length, said device comprising:

a front section; and a rear section having at least the same length as the given length of the binding element, said rear section having a curved surface area and an outer area, said curved surface area being of a cylindrical configuration which has an opening angle of at least 180 degrees, wherein said rear section is dimensioned such that, when the device is inserted into the binding element, the ring elements come into contact, successively with said outer area of said rear section, and wherein the free ends of the ring elements are spaced at least up to a specified distance from the spine.

3. A device for opening a binding element which receives perforated sheets, the binding element having a spine and a plurality of spaced ring elements, arranged side-by-side along the spine, each ring element having a free end resiliently engaged with the spine when the binding element is closed, the binding element further having a given length, said device comprising:

a front section; and a rear section having at least the same length as the given length of the binding element, said rear section having a curved surface area and an outer area, wherein both said front section and said rear section have essentially the same curvature, said rear section is dimensioned such that, when the device is inserted into the binding element, the ring elements come into contact, successively with said outer area of said rear section, and wherein the free ends of the ring elements are spaced at least up to a specified distance from the spine.

4. The device as defined in claim 1, wherein said curved surface area has the curvature of an ellipse.

5. The device as defined in claim 1, further comprising:

an abutment strip, extending essentially parallel to said flat element, wherein said curved surface area includes a free edge, and wherein said abutment strip is affixed to the free edge of said curved surface area.

6. The device as defined in claim 1, further comprising:

a second curved surface area which adjoins said flat element.

7. The device as defined in claim 1, wherein the free edge of one of: said flat element and the second curved surface area on the side close to the free ends of the ring elements include indentations for the alignment of the ring elements.

8. The device as defined in claim 2, wherein parallel grooves are provided on the outside of said cylindrical surface area, said grooves extending essentially vertically to the radius of the cylindrical surface area.

9. The device as defined in claim 8, wherein the relative distance of said grooves is dimensioned to enable the device to accommodate a variety of binding element formats.

10. The device as defined in claim 1, wherein a plurality of first curved surface areas are provided, which are arranged at different distances from one of: the straight edge of said flat front section and said rear section.

11. The device as defined in claim 3, further comprising:

rib members arranged on the inside of said curved surface area of at least the rear section, said rib members extending parallel to each other and aligned essentially vertically to the radius of curvature.

12. The device as defined in claim 4, further comprising:

an abutment strip, extending essentially parallel to said flat element, wherein said abutment strip being affixed to the free edge of said curved surface area.

13. The device as defined in claim 5, further comprising:

a second curved surface area which adjoins said flat element.

14. The device as defined in claim 6, wherein the free edge of one of said flat element and the second curved surface area on the side close to the free ends of the ring elements include indentations for the alignment of the ring elements.

15. The device as defined in claim 1, wherein said curved surface area is of a cylindrical configuration which has an opening angle of at least 180 degrees.

16. The device as defined in claim 7, wherein a plurality of first curved surface areas are provided, which are arranged at different distances from one of: the straight edge of said flat front section and said rear section.

17. The device as defined in claim 2, wherein a plurality of first curved surface areas are provided, which are arranged at different distances from one of the straight edge of said flat front section and said rear section.

* * * * *